United States Patent [19]

Oestreich et al.

[11] Patent Number: 4,773,299

[45] Date of Patent: Sep. 27, 1988

[54] WELL PERFORATING APPARATUS AND METHOD

[75] Inventors: Michael L. Oestreich; Norman S. Pollard, both of Katy, Tex.

[73] Assignee: Halliburton Company, Duncan, Okla.

[21] Appl. No.: 146,271

[22] Filed: Jan. 20, 1988

Related U.S. Application Data

[62] Division of Ser. No. 865,239, May 19, 1986.

[51] Int. Cl.[4] ..... E21B 1/02; E21B 43/117

[52] U.S. Cl. ..... 89/1.15; 102/310; 175/4.6

[58] Field of Search ..... 175/4.6, 4.51, 4.58; 89/1.15; 102/310

[56] References Cited

U.S. PATENT DOCUMENTS

| | | | |
|---|---|---|---|
| 2,256,419 | 9/1941 | Tinnerman | 403/357 |
| 2,402,153 | 6/1946 | Elliott | 89/1.15 |
| 2,433,231 | 12/1947 | Martin | 89/1.15 |
| 2,565,788 | 8/1951 | Tow | 175/4.58 |
| 2,649,046 | 8/1953 | Davis | 102/310 |
| 2,680,406 | 6/1954 | Austin | 102/310 |
| 2,742,857 | 4/1956 | Turechek | 102/310 |
| 2,750,885 | 6/1956 | Schlumberger | 89/1.15 |
| 2,756,677 | 7/1956 | McCullough | 102/310 |
| 2,764,938 | 10/1956 | Harcus | 175/4.6 |
| 2,980,017 | 4/1961 | Castel | 89/1.15 |
| 3,175,617 | 3/1965 | North | 166/55.1 |
| 3,346,056 | 10/1967 | Bohn | 175/4.6 |
| 3,589,453 | 6/1971 | Venghiattis | 175/4.6 |
| 3,666,030 | 5/1972 | Bohn et al. | 175/4.56 |
| 3,773,119 | 11/1978 | Shore | 175/4.6 |
| 4,194,577 | 3/1980 | Vann | 175/4.51 |
| 4,312,273 | 1/1982 | Camp | 102/310 |
| 4,326,462 | 4/1982 | Garcia et al. | 102/310 |
| 4,467,878 | 8/1984 | Ibsen | 175/4.6 |
| 4,541,487 | 9/1985 | Revett | 166/297 |
| 4,583,602 | 4/1986 | Ayers | 175/4.52 |
| 4,635,734 | 1/1987 | Donovan et al. | 175/4.6 |
| 4,640,370 | 2/1987 | Wetzel | 89/1.15 |
| 4,655,138 | 4/1987 | Regalbuto et al. | 102/310 |

FOREIGN PATENT DOCUMENTS

| | | |
|---|---|---|
| 1422004 | 5/1959 | France . |

*Primary Examiner*—David H. Brown

*Attorney, Agent, or Firm*—James R. Duzan; E. Harrison Gilbert, III

[57] ABSTRACT

A perforating gun is designed to have explosive charges spirally disposed around its circumference in accordance with a displacement angle defined as (m/p) (360°), where p is a whole number greater than 4 and m is a whole number greater than 1 but less than (p-1) and where m/p is an irreducible fraction. A U, or horseshoe, shaped retainer clip holds individual charges in respective holes and cavities of an outer carrier tube and an inner carrier tube to prevent horizontal or transverse movement of each charge and thereby hold it in contact with an axially extending detonator cord.

6 Claims, 2 Drawing Sheets

WELL PERFORATING APPARATUS AND METHOD

This is a divisional of co-pending application Ser. No. 865,239 filed on May 19, 1986.

BACKGROUND OF THE INVENTION

This invention relates generally to perforating apparatus and methods and more particularly, but not by way of limitation, to a design for such apparatus and methods by which these are implemented to incorporate spirally distributed charges held in place by respective retainer clips.

One means for facilitating the flow of an oil or gas well includes perforating the formation and any casing or lining adjacent the formation. To perforate, a perforating gun, loaded with explosive charges, is lowered into the well to the desired depth on a tubing string or a wireline as known to the art. A perforating gun generally has an elongated tubular configuration, and the charges are frequently cup-like members holding conically constrained explosive material. Once lowered into the well on the tool, the charges are ignited and fired into the formation in a known manner.

The spatial distribution of the charges on the gun is an important consideration in designing a particular type of perforating gun and in designing a particular perforation job because this design affects the integrity of the gun and the ability of the gun to produce effective perforations. As to the integrity of the gun, the distribution of the charges affects the shock load applied to the gun structure upon a detonation of one or more of the charges. For example, a gun having a known distribution using three charges clustered on a common transverse plane of the gun and fired by a common detonator cord receives a greater shock load than a gun having a similarly sized single charge per transverse plane because in the former the three charges are fired simultaneously whereas in the latter only one is fired at a time. The distribution of the charges also affects the collapse strength of the gun. For example, in a gun having an outer body along which are formed scallops through which the charges are fired, the gun will more readily collapse (and thus have a weaker collapse strength) when longitudinally aligned ones of the scallops are longitudinally closer together. Thus, from the integrity of the gun standpoint, a more durable gun is one having the fewest number of charges per transverse plane to be ignited at one time and having the greatest spacing between longitudinally aligned charges or scallops in a scalloped bdoy. These two particular design factors considered alone, however, may not produce the most effective perforating job.

To produce an effective perforating job, the perforations of course need to enter the desired zone. Although longitudinal spacing between charges is only a few inches at most in present perforating guns, such seemingly close spacing can constitute a sufficiently great distance that certain oil or gas containing formations are missed. These formations are very thin strata known as lensatic or laminated formations. Thus, the longitudinal spacing needs to be relatively close when the gun is to be used to perforate such a thin formation.

To produce an effective perforating job in a highly deviated hole traversing an unconsolidated formation, the charges need to be distributed so that a majority of the load is fired in one of two general directions to prevent damaging, rather than improving, the flowability of the formation. That is, in a highly deviated hole traversing an unconsolidated formation, the majority of the charges are preferably fired in a downward direction when the perforating occurs in a relatively horizontal portion of the deviated hole because if equal amounts are fired upward and downward, or if a majority is fired upward, the unconsolidated formation might collapse onto the gun and clog the well bore.

Still another factor related to the effectiveness of the perforating job is the distance of the apex of a conically shaped charge from the first obstacle or target through which the charge is to be fired. This distance is referred to as the "standoff." In a gun having the aforementioned scalloped outer body, the first obstacle or target is the body wall defining the bottom of the scallop with which the respective charge is radially aligned. The spacing between the charge's apex and this wall is important because the greater the spacing, the better formed is the explosive jet generated by the detonation of the charge. The better formed the jet is, the better the resultant perforation will likely be.

These factors are known to the art, and perforating guns which to some degree meet one or more of them are known. One type of gun has a single spiral distribution of charges along a given length of the gun. This has a relatively great strength against collapse because any longitudinally aligned charges are spaced a distance equal to or greater than the given length along which this single spiral occurs. This design also creates a relatively small shock load because only one charge is located on a transverse plane and fired at any one time. This design can be adapted to have an adequate standoff and to provide for directional firing of a majority of the charges. This design, however, is relatively poor at producing effective perforations. An example of this type of distribution is illustrated in FIG. 1(*a*).

Another type of distribution, previously alluded to as a cluster type, has multiple charges located on a common transverse plane with adjacent sets of clusters longitudinally spaced by a few inches and circumferentially offset. This offset is referred to as "phasing," and in one specific configuration known to be is 60°. In this specific design, a first cluster of three charges is positioned at a first transverse plane of the gun with each of the three charges angularly spaced from the next by 120°. A second cluster of three charges is located in a second transverse plane three inches below the first transverse plane. The three charges of this second cluster are spaced 120° from each other, but each of these charges is also offset 60° from the longitudinal plane containing the center of a respective one of the charges in the first cluster. A third cluster is spaced three inches below the second, but longitudinally aligned with the first cluster and thereby offset 60° from the second cluster. A fourth cluster is spaced three inches below the third, but longitudinally aligned with the second set. This distribution, illustrated in FIG. 1(*b*), has a relatively good collapse strength (not as good as the first mentioned design, however), but it has a relatively high shock load because each charge within a cluster is fired simultaneously with the other two. This design yields an improved perforating performance over the first mentioned design, but it cannot be readily adapted to improve standoff because the three charges abut each other, thereby preventing further transverse displacement of a charge away from the outer wall of the gun. Furthermore, the illustrated three-charge cluster design has an even distribution of charges which prevents focusing a majority of them in a single general direction. It also is somewhat limited in how longitudinally close together the clusters can be set so that this design is not an optimum one for effectively perforating very thin formations.

Still another type of distribution design is a 120° phasing, multiple spiral pattern, which is illustrated in FIG. 1(*c*). This design has one charge per transverse plane with subseqeunt charges longitudinally spaced one inch below and 120° from the preceding one. This design has the poorest collapse strength of the three mentioned designs, but it has a lower shock load than the second-mentioned design. This third design produces the best perforating array of the three, and it can fire a majority of its charges in one general direction. By having only a single charge per transverse plane, it is adaptable for improving its standoff.

Although there are perforating guns which perform satisfactorily in particular uses, there is the need for an improved design for a gun which would be adaptable to satisfy within a single gun all of the aforementioned factors of shock load, collapse strength, directional firing of a majority of the charges, increased standoff, and better shot coverage in an overall combination which none of the aforementioned designs individually satisfies.

SUMMARY OF THE INVENTION

The present invention meets the need for an improved design by providing a novel and improved perforating apparatus and method which, in the preferred embodiment, incorporates a multiple spiral pattern for receiving explosive charges and utilizes a novel and improved retainer clip to hold the charges within the apparatus. The present invention is adapted to incorporate each of the five factors in an overall combination which is improved over the aforementioned designs. In general, the present invention provides a design which is at least substantially as effective as any of the three designs (and significantly better than the first mentioned design) in producing a good, low shock load shot pattern for perforating even very thin formations. The present invention can provide an improved collapse strength over at least the second and third mentioned designs, and it is also adaptable for directional firing of a majority of its charges. It can also be adapted to accommodate increased standoff to improve formation of the generated explosive perforating jets. In addition, the present invention provides a readily adaptable design from which any of several specific charge distributions can be quickly and precisely determined. The present invention also provides a novel and improved retaining clip to retain charges at the designed locations.

The perforating apparatus of the present invention comprises a perforating gun body and carrier means, disposed in the perforating gun body, for carrying a plurality of explosive charges so that, when the explosive charges are carried thereby, each successive explosive charge is laterally spaced from a preceding one by an angle (m/p)(360°), where p is a whole number greater than 4 and m is a whole number greater than 1 but less than (p−1), and where m/p is an irreducible fraction. More specifically, the carrier means includes a charge holder tube having a plurality of holes defined therein. Each of these holes is disposed so that it is bisected by a respective imaginary transverse plane extending parallel to, and spaced longitudinally from, similar respective imaginary transverse planes bisecting the other holes. Each of these holes further is disposed so that it is bisected by a respective imaginary longitudinal plane wherein the imaginary longitudinal plane of a first one of the holes intersects the imaginary longitudinal plane of a second one of the holes at the (m/p)(360°) angle, which second one of the holes is the one bisected by the respective one of the imaginary transverse planes longitudinally closest to the imaginary transverse plane bisecting the first one of the holes. This definition of the design particularly accommodates the collapse strength, shock load, and perforation coverage factors. If p is further defined to be an odd number, the design permits a majority of the charges to be directionally fired in a single general direction.

To accommodate the standoff factor, the preferred embodiment of the carrier means includes the aforementioned charge holder tube as an outer charge holder tube. This carrier means also includes an inner charge holder tube disposed axially through the outer charge holder tube. The inner charge holder tube has a plurality of cavities defined therein, with each of the cavities being aligned with a respective one of the holes of the outer charge holder tube so that each of the cavities is disposed for receiving an initiation end of an explosive charge near a center line of the perforating gun body. Each of these cavities is particularly defined to receive the respective explosive charge so that the initiation end of the respective explosive charge extends across the center line of the perforating gun body to a side thereof opposite from which the discharge end of the respective explosive charge extends, but without extending on that side beyond the perimeter of the inner charge holder tube.

The method of the present invention is for perforating a subterranean surface within a well bore in which a plurality of explosive charges is disposed. This method comprises detonating a first explosive charge and detonating a second explosive charge displaced from the first explosive charge by the (m/p)(360°) angle.

The retainer clip of the preferred embodiment is an article for holding an explosive charge, having an outer edge, in a perforating gun, which has a wall with an outer surface, an inner surface and a transverse surface extending between the outer and inner surfaces to define an opening through the wall. This article comprises first retainer means for engaging the outer edge of the explosive charge and the inner surface of the wall when the article holds the explosive charge within the opening in the wall, second retainer means for engaging the outer edge of the explosive charge and the inner surface of the wall when the article holds the explosive charge within the opening in the wall, third retainer means for engaging the outer edge of the explosive charge adjacent the outer surface of the wall when the article holds the explosive charge within the opening in the wall, first connector means, extending through the opening in the wall, for connecting the first retainer means and the third retainer means, and second connector means, extending through the opening in the wall, for connecting the second retainer means and the third retainer means. In the preferred embodiment, wherein the explosive charge has a portion of its outer edge protruding through the hole in the wall beyond the outer surface of the wall to define a protruding lip portion along the outer edge, the article comprises a substantially U-shaped resilient member having its opposite linear portions respectively defining the first and second connector means and having its curved portion defining the third retainer means. This resilient member further has a first integral lateral protuberance defining the first retainer means and a second integral lateral protuberance defining the second retainer means. The two lateral protuberances extend from the opposite linear portions so that when the protuberances engage the inner surface of the wall, the curved portion engages the lip of the explosive charge.

Therefore, from the foregoing, it is a general object of the present invention to provide a novel and improved perforating apparatus and method. Other and further objects, features and advantaegs of the present invention will be readily apparent to those skilled in the art when the following description of the preferred embodiment is read in conjunction with the accompanying drawings.

DETAILED DESCRIPTION OF THE PREFERRED EMBODIMENT

In general, a perforating gun has a tubular shape with explosive charges located around the circumference of a tubular carrier contained within an outer perforating gun body. Angular displacements between charges can be defined by dividing the 360° of the tubular circumference into appropriate sectors. The use of angular displacements stated in units of degrees will be used herein for purposes of simplicity; however, displacements can also be equivalently identified in lineal circumferential distances based upon the formula $2\pi r$, where r is the radius of the particular carrier. Because the present invention is adaptable to carriers and perforating guns of different diameters, and thus of different radii, units of degrees will be used for simplicity.

Figure 1:
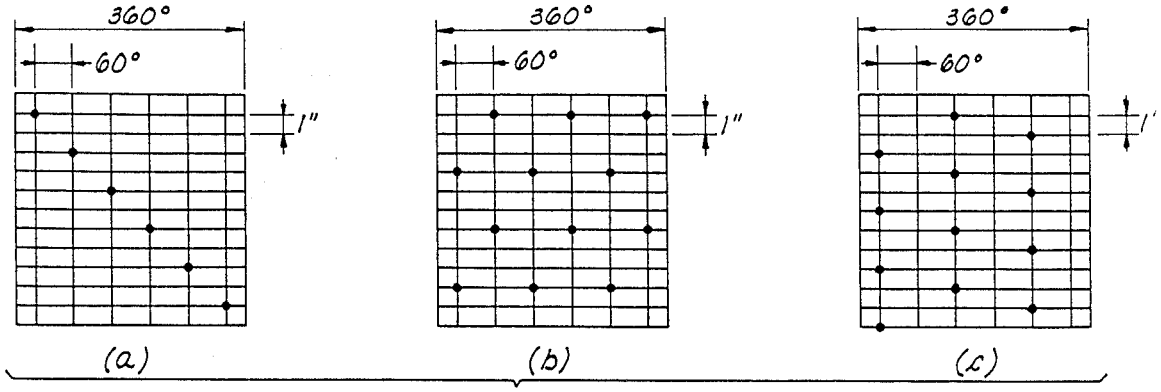
FIG. 1 PRIOR ART
FIGS. 1(*a*), 1(*b*) and 1(*c*) are graphical depictions of the three prior art charge distribution designs referred to hereinabove.
Figure 2A:
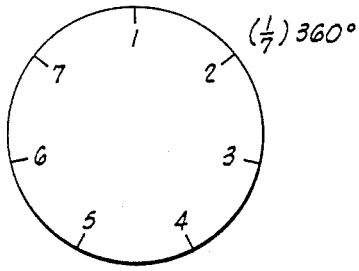
FIGS. 2A and 2B illustrate a distribution design similar to that of FIG. 1(*a*), but having a phasing factor of 7.
Figure 2B:
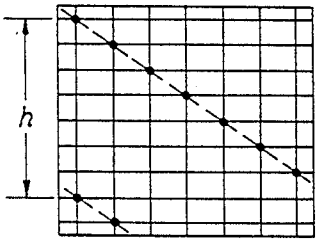

A distribution of explosive charges can be readily designed in a spiral by selecting a whole number, referred to as a phase factor, and dividing it into 360°. For example, for three charges to be displaced around a circumference, a phasing of 360°/3 or 120° would be chosen for equiangular distribution. For four charges, 360°/4 or 90° phasing would be used; for five, the phasing would be 360°/5 or 72°; for six charges, 360°/6 or 60° phasing; and so on. Also to be selected is a longitudinal spacing between the charges. For example, the longitudinal spacing could be one inch, two inches, three inches or whatever spacing is desired and can be accommodated depending upon the size of the charges and any interference therebetween in physically mounting them on the perforating gun carrier structure. Selecting this longitudinal spacing determines the overall length, referred to herein as a height or longitudinal length h, for one series of charges arrayed at the selected phasing and longitudinal separations. The foregoing selections result in a single spiral such as is illustrated in FIG. 1(*a*) (six charges or shots, spaced at 60° phasing and at two-inch longitudinal increments for an h=12 inches) and in FIGS. 2A and 2B (seven charges, spaced at 360°/7 phasing and at one-inch longitudinal increments for an h=7 inches). As indicated hereinabove, however, such single spiral configuration has a particular shortcoming with respect to the effectiveness of the formation perforation that can be performed with such a design.

The concept of our invention is to take this basic design criterion by which a single spiral pattern can be developed and use a multiplier with it so that a multiple spiral distribution is achieved within the same basic length, h, thereby improving the resultant perforation pattern while retaining the desirable features of a single spiral design, namely, good collapse strength, low shock load, standoff improvement capability, and directional firing of a majority of the charges. The good collapse strength is retained by the present invention because as subsequently defined, it requires five or more charges per height increment h so that the closest longitudinally aligned charges are spaced a longitudinal distance of at least five times the intermediate incremental longitudinal spacing. Low shock load is maintained because only one charge is located per transverse plane of the perforating gun, which one charge per plane design also allows the standoff improvement capability because there is no abutting second charge on the same plane to limit the transverse movement of the charge across the center line of the gun. The directional firing capability can be implemented by using an odd number for determining the phasing whereby a majority of the charges will be disposed on half of the perforating gun (i.e., along a 180° sector of the gun).

This concept is implemented by using the following formula which was derived for this purpose: (m/p)(360°), where m is the multipler and p is the phase determinant (and also the determinant of how many charges are to be placed in a single section or one complete spiral increment h). This formula must be implemented with certain limitations on the values of m and p to provide a gun which has a better overall combination of the factors of collapse strength, shock load, directionality, standoff and formation coverage.

In general, these limitations require at least one of the following to be true:

1. p is a prime number greater than 3 and m is a whole number greater than 1 and less than p−1; or 2. p is an odd number and m is an even number greater than 1 and less than p−1 and m/p is an irreducible fraction; or 3. p is an even number and m is an odd number greater than 1 and less than p−1 and m/p is an irreducible fraction.

Upon combining these into a single definition, these criteria require that p be a whole number greater than 4, that m be a whole number greater than 1 but less than p−1 and that m/p be an irreducible fraction.

The parameter m needs to be greater than 1 and less than p−1 because either of these values for the multipler would define only a single spiral (m=1 being a single spiral in one direction and m=p−1 being a single spiral in the opposite direction). The fraction m/p must be irreducible because otherwise it would be equivalent to a more simply defined pattern and possibly one which would be only a single spiral (e.g., 3/6 =½). In view of the foregoing requirements, p is of necessity greater than 4 because if p=3, there would be no acceptable value for m as the only possible values for m would be 1 or 2 and these are not allowed under the restriction to m (they would each define only a single spiral). The phase parameter p cannot equal 4 because of this same reason applied to the possible values of 1 or 3 for m, and also because if m=2, then a reducible fraction, 2/4, would result.

Although the parameter p is restricted to a whole number greater than 4, p is also constrained by the other restrictions whereby numbers that are greater than 4 may not be selectable. For example, if p=6, the possible values for m would be 1, 2, 3, 4 or 5; however, 1 and 5 are not permitted because of the restriction to m so that single spirals will not be designed, and the m=2, 3 or 4 would result in reducible fractions. Thus, p is more preferably defined to be a prime number equal to or greater than 5 (or simply a prime number greater than 3).

By further restricting p to being an odd number, a phasing results wherein a majority of the charges is directed from half of the gun. For example, if p=7, then four of the seven charges in a single section would lie within one 180° sector of the gun. Thus, this sector could be positioned to direct this majority of the load in a desired direction (e.g., downward in a horizontal section of a highly deviated well bore extending in an unconsolidated formation).

From these requirements of the present invention it will be observed that phasing of 60°, 90° and 120° is prohibited in the present invention because these would require p to equal 6, 4 or 3, respectively, which values have been shown not to be acceptable within the restrictions of the present invention. It will be further observed that the definition of the aforementioned formula requires the basic phasing, determined by p, to be less than 120°. Furthermore, the angular displacement between two successive charges will always be greater than the basic phase angle, but the angularly closest charges will be spaced by only the basis phasing angle. These relationships are illustrated in FIGS. 3A–3B and 4A–4B.

Figure 3A:
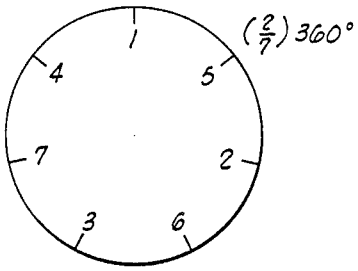
FIGS. 3A and 3B illustrate a specific charge distribution design developed in accordance with the preferred embodiment of the present invention.
Figure 3B:
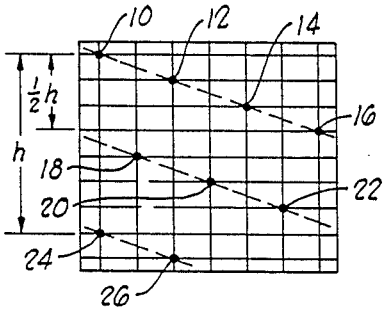

FIG. 3A is a schematic end view of a tubular carrier member having charges to be successively ignited in the order designated by the consecutive numbers 1–7. This distribution, based on values of p=7 and m=2, is better illustrated in FIG. 3B which represents an unfolded section of the tubular carrier. In FIG. 3B, a charge 10 corresponding to location 1 in FIG. 3A is shown. Charges 12, 14, 16, 18, 20, 22, corresponding, respectively, to locations 2, 3, 4, 5, 6, and 7 in FIG. 3A, are also illustrated in FIG. 3B. Thus, from FIG. 3B it is apparent that charge 12, which is to be ignited next after the charge 10 and before the charge 14, is angularly displaced by an angle (2/7)(360°) from the charges 10 and 14. The charge 12 is longitudinally spaced by a distance one-seventh of the overall section height or length h. In the preferred embodiment it is contemplated that this longitudinal spacing can be any suitable preselected distance, such as one inch (which would make h=7).

FIG. 3B also illustrates the relationship represented in FIG. 3A by locations 1, 5 and 2. That is, in FIG. 3B, the charge 18, disposed at location 5 designated in FIG. 3A, is angularly in between the charges 10 and 12 as depicted in FIG. 3A so that the angular spacing between charges 10, 18 and between charges 18, 12 is the basic phase angle of 360°/7. The charge 18 is, however, four longitudinal spacing increments (or 4/7 of the total length h) below the charge 10.

As is apparent from FIGS. 3A and 3B, there are seven charges phased throughout the height h at the basic phase angle 360°/7, or approximately 51.43°. By selecting the multipler parameter as 2, however, the angular spacing or displacement between successive or most closely longitudinally spaced charges is two times the basic phase angle, or approximately 102.86°.

FIG. 3B also illustrates the beginning of a second series of similarly disposed charges commencing with charges 24, 26. It is to be noted that the charge 24 is longitudinally aligned with the charge 10 but at a spacing equal to the height h. Thus, significant spacing is maintained between these two charges (and the corresponding other longitudinally aligned charges) so that relatively good collapse strength is maintained in a gun designed in accordance with the present invention.

Figure 4A:
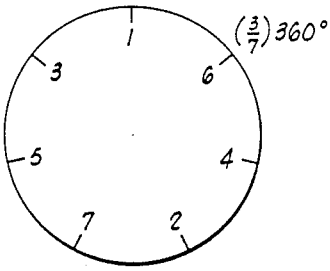
FIGS. 4A and 4B illustrate another specific charge distribution design developed in accordance with the preferred embodiment of the present invention.
Figure 4B:
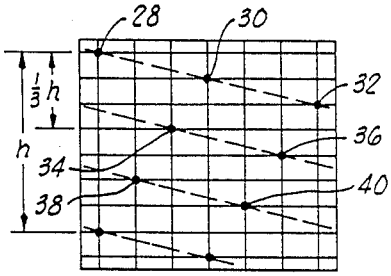

FIGS. 4A and 4B make similar depictions to those shown in FIGS. 3A and 3B, except that FIGS. 4A and 4B use a multipler parameter of m=3, but for the same basic phasing determined by the same phasing parameter of p=7. In FIG. 4B charges 28, 30, 32, 34, 36, 38, 40 correspond to locations 1, 2, 3, 4, 5, 6, 7, respectively, shown in FIG. 4A. The grid contained in FIG. 4B is of the same scale as that used in FIG. 3B; therefore, no further explanation is deemed necessary because it is explicit from the drawings themselves.

This charge loading concept of the present invention is adaptable for any suitable size of perforating gun; however, it is contemplated that it is most easily applied on relatively large diameter guns, such as one having nominal four and five-eighth's inch or six-inch outer diameters and having a detonation cord placed on or near the vertical center line of the gun and having the charges placed such that the initiation end of the charges is on or slightly over the center line without causing charge interference, thereby increasing standoff between the output or discharge end of the charges and the outer body of the gun.

Figure 5:
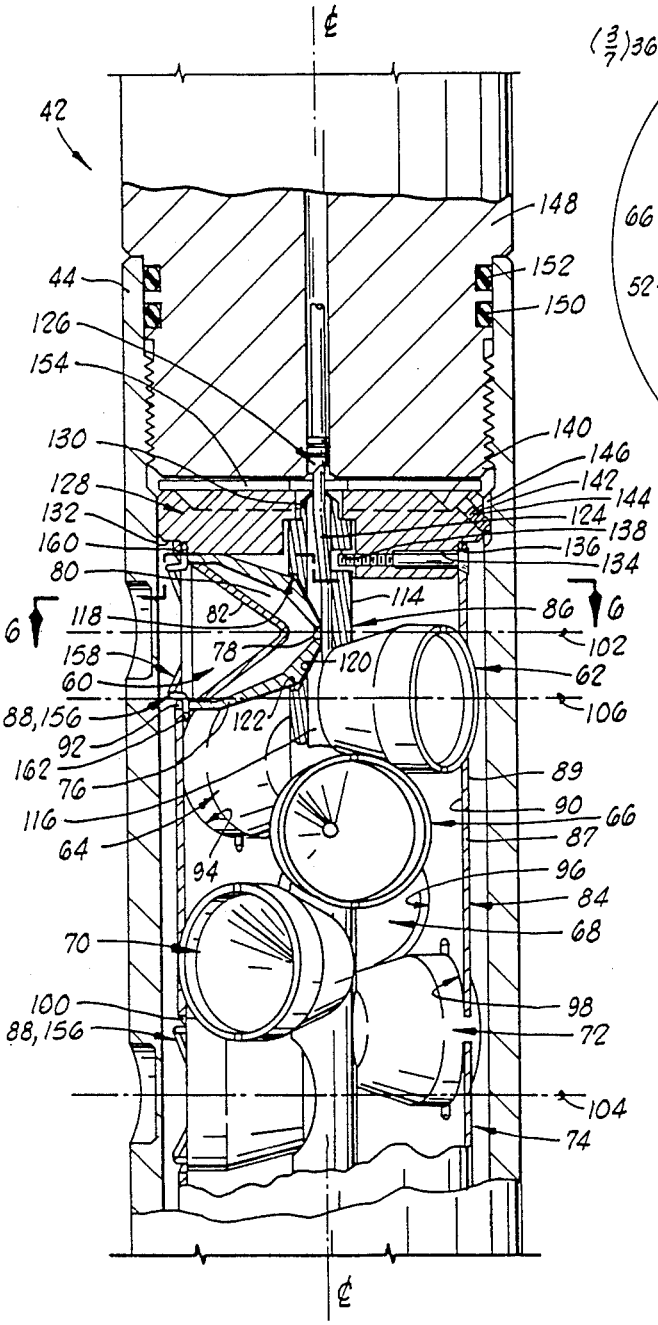
FIG. 5 is a sectional view of a portion of a perforating gun constructed in accordance with the preferred embodiment of the present invention.
Figure 6:
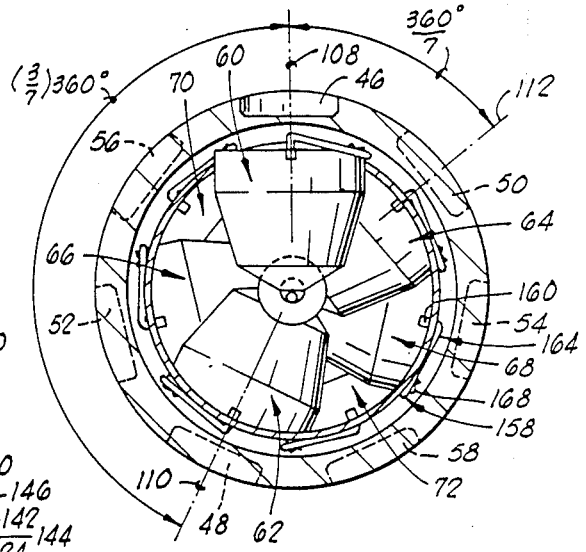
FIG. 6 is a sectional view taken along line 6—6 shown in FIG. 5.

One such perforating gun designed in accordance with the foregoing design criteria of my present invention is generally designated by the reference numeral 42 in FIGS. 5 and 6. Although having a unique design, the gun 42 is to be utlimately used in any suitable known manner, such as by being lowered into a well bore on a tubing string or a wire-line and thereafter being activated by mechanical impact or electrical energization. Only part of the gun 42 is shown in the drawings because the remainder of the design follows from what is shown and is otherwise fabricated of materials and means known to the art.

The perforating gun 42 includes an outer perforating gun body 44 made of a cylindrical sleeve having a plurality of scallops 46, 48, 50, 52, 54, 56, 58 defined therein. The positions of the scallops are determined in accordance with the foregoing formula and specifically selected ones of the phasing parameter p and the multipler parameter m. Radially aligned with each of the scallops 46, 48, 50, 52, 54, 56, 58 is a respective one of a plurality of conically shaped explosive charges 60, 62,

64, 66, 68, 70, 72, respectively. These charges are retained by a carrier means 74 disposed in the perforating gun body 44 for carrying the plurality of explosive charges.

Each of the charges 60, 62, 64, 66, 68, 70, 72 is identically constructed in a manner as known to the art. As indicated in FIG. 5, each charge generally has a support cup 76 through which an aperture 78 is defined at the apex of the cavity defined by the outer wall of the cup 76. It is through the aperture 78 that a firing mechanism is connected into the explosive material contained in a constraint volume 80 defined between the inner surface of the cup 76 and a conical liner 82. This constrains the explosive material in a hollow, substantially conical configuration, the apex of which is adjacent the aperture 78.

In the preferred embodiment of the gun 42, each charge is disposed on its own level or height of the gun and is to be individually detonated so that only a single shot load is fired at one time. This thus generates in the preferred embodiment a relatively low shock load, particularly with respect to a cluster type of design wherein more than one charge is detonated at a time. By detonating only one charge at a time in the preferred embodiment, a charge having a greater explosive load than used in a single charge of a cluster design, but less than the combined charge of the cluster, can be used and still generate a relatively smaller shock load.

The charges 60, 62, 64, 66, 68, 70, 72 are supported within the perforating gun body 44 by an outer charge holder tube or sleeve 84, an inner charge holder tube or sleeve 86, and a retaining means 88. The tubes 84, 86 and the retaining means 88 constitute the carrier means 74 of the preferred embodiment.

The outer charge holder tube or sleeve 84 is a cylindrical member having a relatively thin but sturdy wall 87 having an outer surface 89, an inner surface 90, and transverse surfaces extending between the outer surface 89 and the inner surface 90 to define a plurality of holes. Five such holes 92, 94, 96, 98, 100 are identified in FIG. 5. Three additional holes are defined in association with the positions of the charges 62, 66, 70 in the section of the tube 84 not shown in FIG. 5. The hole 100 is associated with a charge that begins a second section of charges disposed similarly to the charges 60, 62, 64, 66, 68, 70, 72, but longitudinally spaced the section distance h below the corresponding ones of the charges in the fully illustrated section.

Each of the holes with which one of the charges is associated is defined at a location of the wall 87 in accordance with the angle specified by the formula (m/p)(360°) and selected ones of the parameters p and m (in the illustrated embodiment p=7 and m=3). With the holes so defined, there is a discharge end of a respective explosive charge facing radially outwardly therethrough when the perforating gun 42 is fully assembled.

The holes in the outer tube 84 are disposed so that each is bisected by a respective imaginary transverse plane extending parallel to, and spaced longitudinally from, similar respective imaginary transverse planes bisecting the other holes. Two of these transverse planes are identified in FIG. 5 with reference to the holes 92, 100. The plane identified with the hole 92 is identified by the reference numeral 102, and the plane identified with the hole 100 is identified by the reference numeral 104. Because each of these planes also bisects the charge associated with the respective holes, a third transverse plane 106 is shown bisecting the charge 62. Because the charge 60, associated with the hole 92, and the charge 62 are charges to be successively detonated, the perpendicular distance between the planes 102, 106 defines the basic incremental longitudinal spacing adopted for the embodiment shown in FIGS. 5 and 6. In the preferred embodiment this spacing equals approximately one inch; therefore, the overall section length or height h is seven inches, which is thus the longitudinal spacing between the planes 102, 104.

Each of the holes disposed in the outer tube 84 in accordance with the formula of the present invention is disposed so that it is also bisected by a respective imaginary longitudinal plane, wherein the imaginary longitudinal plane of a first one of the holes intersects the imaginary longitudinal plane of a second one of the holes at the computed angle, which second one of the holes is the one bisected by the respective one of the transverse planes longitudinally closest to the imaginary transverse plane bisecting the first one of the holes. Three of these imaginary longitudinal planes are identified in FIG. 6 by the reference numerals 108, 110, 112. The plane 108 vertically bisects the hole 92 and the charge 60 associated therewith as shown in FIG. 6. The plane 110 bisects the charge 62 and the hole associated therewith, and the plane 112 bisects the charge 64 which is spaced longitudinally farther below the charge 60 than the charge 62, but angularly closer thereto as indicated by the angular designations shown in FIG. 6. That is, the angle between the planes 108, 110 is equal to the successive charge displacement angle computed by the entire formula (m/p)(360°), whereas the angular displacement between the planes 108, 112 is merely the basic phase angle, 360°/p. In the preferred embodiment shown in FIGS. 5 and 6, p=7 and m=3 so that the basic phase angle is approximately 51.43° and the successive charge displacement angle is approximately 154.29° (i.e., three times the basic phase angle).

When fully assembled, the outer tube 84 supports the output, or discharge, ends of the charges. The initiation ends of the charges are supported by the inner tube 86 which is disposed axially through the outer tube 84 as shown in FIG. 5.

The inner charge holder tube 86 has a hollow cylindrical shape having a smaller outer diameter than the inner diameter of the outer tube 84. The outer diameter of the tube 86 is defined across an outer surface 114. The hollow interior of the tube 86 is defined by an inner surface 116. Defined between these surfaces and in communication with the hollow interior of the tube 86 are a plurality of similarly shaped cavities which are located around the tube 84 in locations defined in accordance with the displacement angle (m/p)(360°). Thus, when the tube 86 is properly aligned and retained relative to the outer tube 84, each cavity is aligned with a respective one of the holes of the outer tube 84. One of these cavities, identified by the reference numeral 118, is shown in FIG. 5 in association with the charge 60.

The cavity 118 has a conical surface 120 radially inwardly offset from the outer surface 114 of the tube 86 by an annular surface 122. The surface 120 adjoins the inner surface 116 of the tube 86 so that an aperture communicating with the hollow interior of the tube 86 is defined. It is through this aperture that the apex end of the charge 60 is received for connection with a detonator cord 124, such as a Primacord, which is supported within the hollow interior of the tube 86 by its own support tube 126. By making the annular surface 122 wider, and thereby forming the conical surface 120 closer to the inner surface 116 of the tube 86, the charge 60 can be more radially inwardly received, thereby increasing the standoff between the charge 60 and the inner surface of the gun body 44 defining the first target to be encountered by the explosive jet formed when the explosive material within the charge 60 is ignited and fired radially outwardly to ultimately perforate the geological formation traversed by the well bore in which the perforating gun 42 is to be used. Thus, by appropriately forming the cavities in the inner tube 86, the initiation end of a respective explosive charge can be made to extend across the center line of the gun 42 along which the detonator cord 124 extends for cooperative couping with each of the explosive charges. This places the apex of the respective charge on a side of the center line opposite from which the discharge end of the respective explosive charge extends. In the preferred embodiment, however, this displacement is not sufficient that the initiation end of the explosive charge extends on this opposite side beyond the outer perimeter defined by the outer surface 114 of the inner charge holder tube 86.

The inner tube 86 is held in axial alignment within the outer tube 84 by an end alignment ring or disk 128 having a central cavity 130 receiving the top end of the tube 86. The ring or disk 128 also has a circumferential groove 132 receiving the top end of the outer tube 84. A radial bore 134 extends through the alignment ring 128 between the groove 132 and the cavity 130. The bore 134 is aligned with a hole 136 defined in the outer tube 84 and a hole 138 defined in the inner tube 86. A set screw 140 extends through the aligned hole 136, bore 134 and hole 138 to maintain the charge receiving holes of the outer tube 86 and the cavities of the inner tube 86 in proper radial alignment once the charges have been disposed therebetween. The alignment ring 128 also has a V-shaped circular groove 140 defined therein on the side opposite the side in which the cavity 130 and the groove 132 are formed. Extending from the groove 140 is at least one oblique bore 142 which receives a set screw 144 extending from the alignment ring 128 into a slot 146 defined in the gun body 44 for fixing the angular relationship between the carrier means 74 and the gun body 44. Held adjacent the alignment ring 128 by a coupling adapter 148, with which sealing members including O-rings 150, 152 are associated, is a charge cushion 154.

Figure 7:
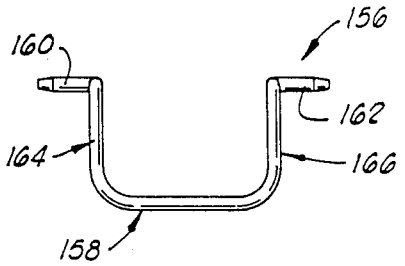
FIG. 7 is a side view of a retainer clip constructed in accordance with the preferred embodiment of the present invention.

Each of the explosive charges of the gun 42 is held in a respective cavity of the inner tube 86 and hole of the outer tube 84 by a respective one of the retaining means 88. As identified in FIG. 5, each retaining means 88 includes a substantially U-shaped or horseshoe-shaped resilient clip 156 having a closed lower portion 158 disposed for overlying an outer edge of the discharge end of the respective explosive charge and for overlying the outer surface 89 of the tube 84 when the explosive charge is disposed adjacent a respective one of the holes. The clip 156 further has an open upper portion which extends from the closed lower portion 158 and from which engagement fingers 160, 162 transversely extend into engagement with the inner surface 90 of the tube 84. This upper portion includes opposite linear portions 164, 166 (see FIGS. 7 and 8). The fingers 160, 162 are integral lateral protuberances extending laterally from the longitudinal extensions of the linear portions 164, 166 so that when the protuberances engage the inner surface 90 of the wall 87, the curved portion 158 of the clip 156 engages a lip of the respective explosive charge. Such a lip is defined by the portion of the outer edge of the explosive charge extending beyond the outer surface 89 of the tube 84. One of these lips is identified in FIG. 6 by the reference numeral 168.

Figure 8:
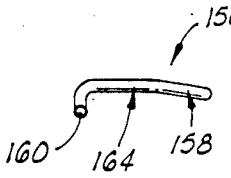
FIG. 8 is an end view of the retainer clip.

The lower closed portion 158 of the preferred embodiment clip 156 defines a support shoulder portion lying in an imaginary plane intersecting an imaginary plane containing the opposite linear portions 164, 166 so that an oblique angle is defined between these two planes. This shoulder portion is integrally formed with L-shaped arms defining the opposite linear portions 164, 166. The longer segments of the arm portions 164, 166 extend from opposite ends of the curved shoulder portion 158. At their opposite ends, the arm portions are bent to form the shorter segments of the L-shapes. As best illustrated in FIG. 8, these shorter segments extend perpendicularly from the longer linear segments of the arms in the same direction towards which the plane containing the shoulder portion 158 bends from the longer segments of the arm portions. It is from these shorter, perpendicular segments of the arm portions that the fingers 160, 162 perpendicularly extend in opposite directions and transversely to the planes defined by the L shapes of the arm portions. These portions are integrally connected in the substantially U, or horseshoe, shape.

The two finger portions 160, 162 define what can be generally referred to as two retainer means for engaging the outer edge of the explosive charge and the inner surface 90 of the tube 84 when the clip 156 holds the explosive charge within the opening or hole defined in the wall 87 of the tube 84. The shoulder portion 158 generally defines a retainer means for engaging the outer edge of the explosive charge adjacent the outer surface 89 of the wall 87 when the clip 156 holds the explosive charge within the opening or hole defined in the wall. The two L-shaped arm portions 164, 166 define respective connector means, each of which extends through the opening in the wall 87, for connecting the two finger retainer means with the shoulder portion retainer means.

To use the clips 156, the two arm portions 164, 166 are biased towards each other so that the finger portions 160, 162 can be inserted in the position between the explosive charge and the inner surface 90 of the wall 87, as best illustrated in FIG. 5. When this is done, the shoulder portion 158 is positioned over the lip portion of the outer edge of the respective charge.

With the foregoing construction utilizing the outer tube 84, the inner tube 86 and the plurality of retaining clips 156, it is apparent that the inner and outer tubes support the charges in a beam loading fashion preventing vertical stackdown whereas the retention springs or clips 156 prevent horizontal or transverse motion of the charges to maintain contact between the charges and the detonator cord 124.

Once the perforating apparatus 42 depicted in FIGS. 5 and 6 has been assembled, it can be used for perforating a subterranean surface within a well bore once the plurality of explosive charges are run into the bore on the apparatus 42. The method of this usage comprises detonating a first one of the explosive charges and detonating a second one of the explosive charges which is displaced from the first explosive charge by the angle (m/p)(360°). That is, the preferred embodiment spirally arrayed charges disposed in accordance with the desired (m/p)(360°) angle are successively detonated through the detonator cord 124 in a sequence wherein the next charge to be detonated is the one most closely longitudinally spaced from the last-fired charge, but laterally separated therefrom by the charge displacement angle computed using both the phase parameter p and the multiplier parameter m. The method further comprises detonating a plurality of other explosive charges in a similar successive manner.

The foregoing provides an apparatus which has a relatively good collapse strength and generates a relatively low shock load. This apparatus also provides a good shot array suiable for both better covering this very thin strata as well as covering wider strata. Because each charge can be positioned across the center line of the gun, better standoff distances can be created. By using an odd number for the phase determinant factor, p, a majority of the load can be directed in one generation direction.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts and the performance of steps can be made by those skilled in the art, which changes are encompassed within the spirit of this invention as defined by the appended claims.

What is claimed is:

1. An article for holding an explosive charge, having an outer edge, in a perforating gun having a wall with an outer surface, an inner surface and a transverse surface extending between the outer and inner surfaces to define an opening through the wall, said article comprising:

first retainer means for engaging the outer edge of the explosive charge and the inner surface of the wall when said article holds the explosive charge within the opening in the wall;

second retainer means for engaging the outer edge of the explosive charge and the inner surface of the wall when said article holds the explosive charge within the opening in the wall;

third retainer means for engaging the outer edge of the explosive charge adjacent the outer surface of the wall when said article holds the explosive charge within the opening in the wall;

first connector means, extending through the opening in the wall, for connecting said first retainer means and said third retainer means; and second connector means, extending through the opening in the wall, for connecting said second retainer means and said third retainer means.

2. An article as defined in claim 1, wherein:

the explosive charge has a portion of its outer edge protruding through the hole in the wall beyond the outer surface of the wall to define a protruding lip portion along the outer edge; and said article further comprises a substantially U-shaped resilient member having its opposite linear portions respectively defining said first and second connector means and having its curved portion defining said third retainer means, said resilient member further having a first integral lateral protuberance defining said first retainer means and a second integral lateral protuberance defining said second retainer means, said first and second lateral protuberances extending from said opposite linear portions so that when said protuberances engage the inner surface of the wall, said curved portion engages the lip of the explosive charge.

3. An article as defined in claim 1, wherein:

said first connector means is characterized as a first arm portion having a first end and a second end;

said first retainer means is characterized as a first finger portion extending from said first end of said first arm portion and transversely thereto;

said second connector means is characterized as a second arm portion having a first end and a second end;

said second retainer means is characterized as a second finger portion extending from said first end of said second arm portion and transversely thereto; and said third retainer means is characterized as a shoulder portion extending between said second ends of said first and second arm portions.

4. An article as defined in claim 3, wherein:

said first and second arm portions lie in a first imaginary plane; and said shoulder portion lies in a second imaginary plane intersecting said first imaginary plane so that an oblique angle is defined between said first and second imaginary planes.

5. An article as defined in claim 3, wherein:

said first and second arm portions both have similar substantially L shapes;

said first finger portion extends transversely to an imaginary plane defined by the L shape of said first arm portion;

said second finger portion extends transversely to an imaginary plane defined by the L shape of said second arm portion; and said shoulder portion has a curved shape.

6. An article as defined in claim 3, wherein said first and second arm portions, said first and second finger portions and said shoulder portions are integrally connected substantially in the shape of a horseshoe.

* * * * *

UNITED STATES PATENT AND TRADEMARK OFFICE

CERTIFICATE OF CORRECTION

PATENT NO. : 4,773,299

DATED : September 27, 1988

INVENTOR(S) : Michael L. Oestreich et al.

It is certified that error appears in the above-identified patent and that said Letters Patent is hereby corrected as shown below:

In column 11, line 34, delete the numeral [86] (first occurrence) and insert therefore --84--.

Signed and Sealed this

Second Day of May, 1989

*Attest:*

*Attesting Officer*

DONALD J. QUIGG

*Commissioner of Patents and Trademarks*